US007392883B2

(12) United States Patent
Hikita

(10) Patent No.: US 7,392,883 B2
(45) Date of Patent: Jul. 1, 2008

(54) ELEVATOR GROUP CONTROL SYSTEM

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 503 days.

(21) Appl. No.: 10/552,998

(22) PCT Filed: Mar. 30, 2004

(86) PCT No.: PCT/JP2004/004511

§ 371 (c)(1),
(2), (4) Date: Oct. 13, 2005

(87) PCT Pub. No.: WO2005/102893

PCT Pub. Date: Nov. 3, 2005

(65) Prior Publication Data

US 2006/0213727 A1 Sep. 28, 2006

(51) Int. Cl.
*B66B 9/00* (2006.01)

(52) U.S. Cl. ..... 187/249; 187/383; 187/388

(58) Field of Classification Search ..... 187/249, 187/247, 380–389, 391–396, 902
See application file for complete search history.

(56) References Cited

U.S. PATENT DOCUMENTS 5,419,414 A * 5/1995 Sakita ..... 187/391
5,663,538 A * 9/1997 Sakita ..... 187/382
5,877,462 A * 3/1999 Chenais ..... 187/249
6,360,849 B1 * 3/2002 Hikita ..... 187/381
6,364,065 B1 * 4/2002 Hikita ..... 187/382
6,619,437 B2 9/2003 Hikita
6,871,727 B2 * 3/2005 Jokela et al. ..... 187/383
7,032,716 B2 * 4/2006 Meyle et al. ..... 187/382

(Continued)

FOREIGN PATENT DOCUMENTS

JP 06-305648 11/1994

(Continued)

OTHER PUBLICATIONS

Atsuya Fujino et al., "Basic Study on Mass Transportation Systems in Buildings by Means of Multiple-cage Elevators", T.IEE Japan, vol. 117-D, No. 7, '97, pp. 815-822.

*Primary Examiner*—Jonathan Salata
(74) *Attorney, Agent, or Firm*—Leydig, Voit & Mayer, Ltd.

(57) ABSTRACT

An elevator group control apparatus collectively controls an elevator system where at least two cars can travel in each shaft independently of each other. The apparatus has a destination floor registration device installed at each hall for passengers to register destination floors and to indicate to passengers which cars will serve respectively for the registered destination floors. Priority zones and a shared zone for upper cars and for lower cars are set; a judgment is made as to whether the shared zone set can be entered by an upper or lower car; a car is put on standby based on the judgment a car is sent to a withdrawal floors, as necessary, after a service is completed. A car is selected as a candidate for assignment to a destination call if, according to the destination to be served by each car and the zones set for each car, so that the car would cause neither collision nor safety stop; and a car is assigned based on the selection.

7 Claims, 5 Drawing Sheets

U.S. PATENT DOCUMENTS

2004/0129502 A1 7/2004 Hikita

FOREIGN PATENT DOCUMENTS

JP 201-335244 12/2001
JP 2002-220164 8/2002
JP 2003-160283 6/2003
JP 2003-312951 11/2003

* cited by examiner

ELEVATOR GROUP CONTROL SYSTEM

TECHNICAL FIELD

The present invention relates to an elevator group control apparatus for efficiently controlling a bank of plural elevators in an elevator system with plural cars serving in each shaft.

BACKGROUND ART

To control a bank of plural elevators, group control is usually conducted to efficiently run these plural elevators. In some elevator systems, a plurality of cars serve in a single shaft. Different greatly from an elevator system where only a single car serves in each shaft, control of such an elevator system is required to not only raise the transportation efficiency but also avoid collision between cars.

For example, the above-mentioned requirement is taken into consideration in Japanese Patent No. 3029168 as known. In that specification, a control scheme is proposed for a horizontally-movable shuttle elevator system where a plurality of independently driven cars are circulated along each common shaft through turnaround spaces provided respectively on the highest and lowest stories. By setting a car approach inhibition zone to each car, the control scheme controls the cars so that each car may not enter this zone of another car.

Another example is described in "Basic studies of shuttle elevator systems for mass transportation in a building", Atsuya Fujino and two others, Trans. of the Institute of Electrical Engineers (Japan) D, 1997, vol. 117, No. 7, p. 815-822. According to this document, the elevator system evaluates the excursion of each car, etc. When a car is coming closer to a floor at which a hall call has occurred, it is determined based on the evaluation whether to stop the car at the hall in response to the call.

However, since the above-mentioned prior art techniques assume application to horizontally movable shuttle elevator systems, it is difficult to apply them to an elevator system where horizontal movement is not possible. That is, since the cars in a shuttle elevator system are assumed to move in the same direction while they move in the same shaft, withdrawing a car depends on its horizontal movement. Therefore, consideration is not given to how to avoid collision and withdraw a car where horizontal movement is not possible.

Moreover, the above-mentioned prior art techniques have another common drawback in that if a car carrying passengers is stopped for safety, the passengers must wait in the closed space. This psychologically disturbs them although the waiting time is short.

The present invention is intended to solve the above-described problem. It is an object of the present invention to provide an elevator group control apparatus capable of preventing collision and minimizing the frequency of safety stops in an elevator system with plural cars in each shaft while efficiently operating the elevator system.

DISCLOSURE OF THE INVENTION

According to an aspect of the present invention, there is provided an elevator group control apparatus for an elevator system where a plurality of cars can move in each shaft independently of each other, comprising: a destination floor registration device which is installed at each hall and can register destination floors and indicates to passengers which cars will respectively respond to serve for the registered destination floors; zone setting means for setting priority zones and a shared zone to upper cars and lower cars; entrance judgment means for judging whether the shared zone set by the zone setting means is allowed to be entered by an upper car or a lower car; safety standby means for putting a car on standby based on the judgment result of the entrance judgment means; withdrawal means for withdrawing a car to a withdrawal floor as necessary after a service is completed by the car; assignment candidate selecting means for selecting a car as a candidate for assignment to a destination call generated at a hall if it is judged, according to the destination to be served by each car and the zones set to each car, that the car would cause neither collision nor safety stop; and assignment means for finally determining which car to assign based on the selection result of the assignment candidate selecting means. Thus, the group control apparatus can minimize the risk of collision and the probability of safety stop while efficiently controlling the elevator system. It is therefore possible to raise the total transportation efficiency of the elevator system.

BEST MODE FOR CARRYING OUT THE INVENTION

Figure 1:
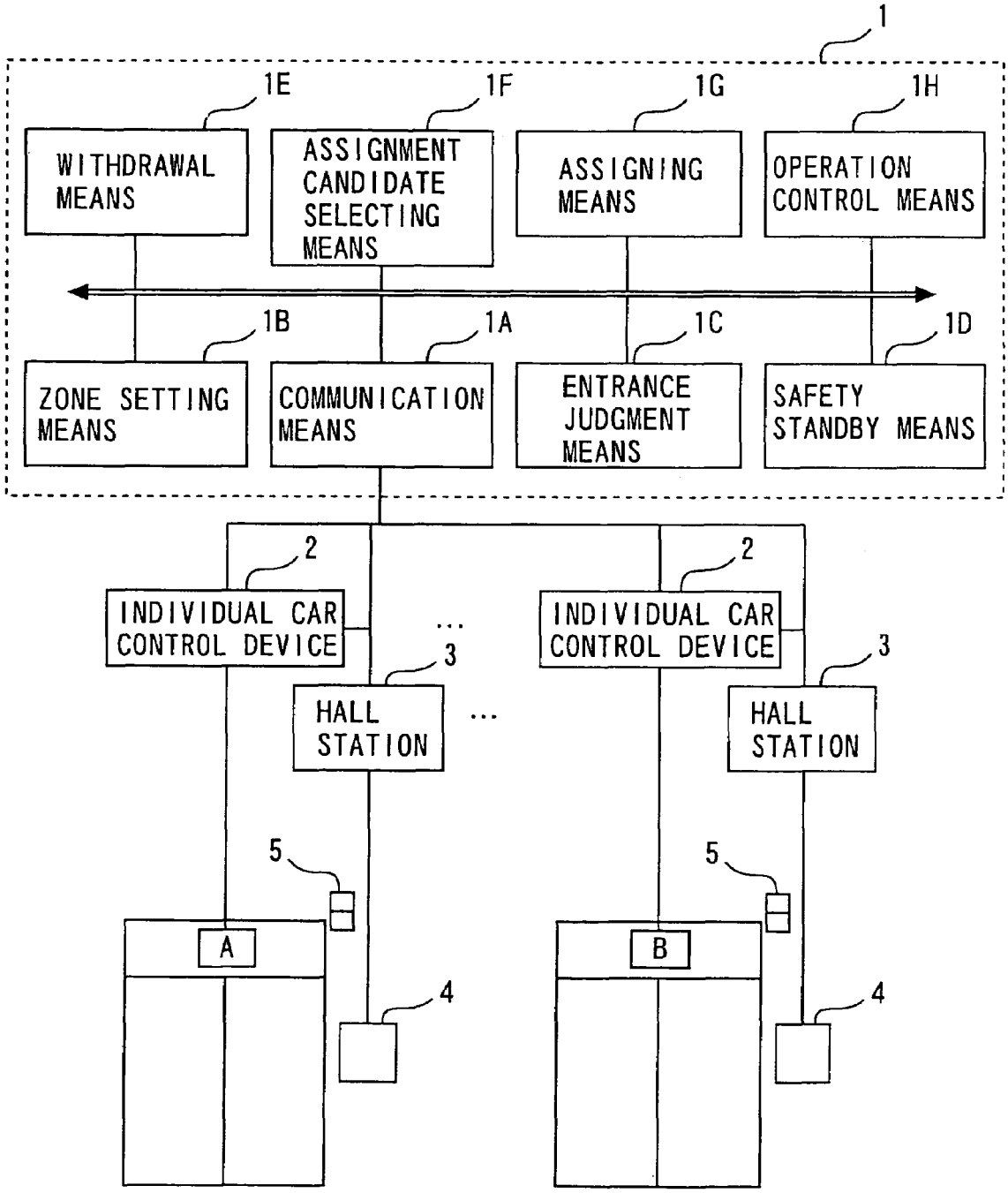
FIG. 1 is a block diagram which generally shows the functional configuration of an elevator group control apparatus in accordance with the present invention.

An embodiment of the present invention will be described below by using the drawings. FIG. 1 is a block diagram which generally shows the functional configuration of an elevator group control apparatus in accordance with the present invention. In FIG. 1, reference numeral 1 denotes a group control apparatus which efficiently controls a plurality of cars. Reference numeral 2 denotes an individual car control device. Reference numeral 3 denotes a hall station which controls a hall lantern, destination floor registration device and other hall devices. Reference numeral 4 denotes a destination floor registration device which allows passengers at the hall to register destination floors and indicates which car (hall) will serve for each registered destination floor. Reference numeral 5 denotes a hall lantern to indicates the arrival of each car. Note that although this embodiment is described on the assumption that two cars serve in each shaft, the present invention is not limited to this configuration. The present invention is applicable to any elevator system which includes a shaft having plural cars for service therein. The elevator system may include any number of shafts and any number of cars in each shaft if the system is collectively controlled as a single bank.

The group control apparatus 1 of FIG. 1 comprises the following means which are implemented by software on a microcomputer.

Reference numeral 1A denotes communication means to communicates with the individual car control devices 2, etc. Reference numeral 1B denotes zone setting means to set priority zones and a shared zone to the upper cars and the lower cars. Reference numeral 1C denotes entrance judgment means to judge whether the shared zone set by the zone setting means 1B is allowed to be entered by a upper/lower car. Reference numeral 1D denotes safety standby means to put a car on safety standby depending on the judgment result of the entrance judgment means 1C. Reference numeral 1E denotes withdrawal means to withdraw a car to a withdrawal floor as necessary after a service is completed by the car. Reference numeral 1F denotes assignment candidate selecting means to select a car as a candidate for assignment to a destination call generated at a hall if it is judged that the car would cause neither collision nor safety stop according to the destination to be served by each car and the zones set to each car. Reference numeral 1G denotes assignment means to finally determine which car to assign based on the selection result of the assignment candidate selecting means 1F. Reference numeral 1H denotes operation control means to control the general operation of each car based on the assignment result of the assignment means 1G and so on.

Figure 2:
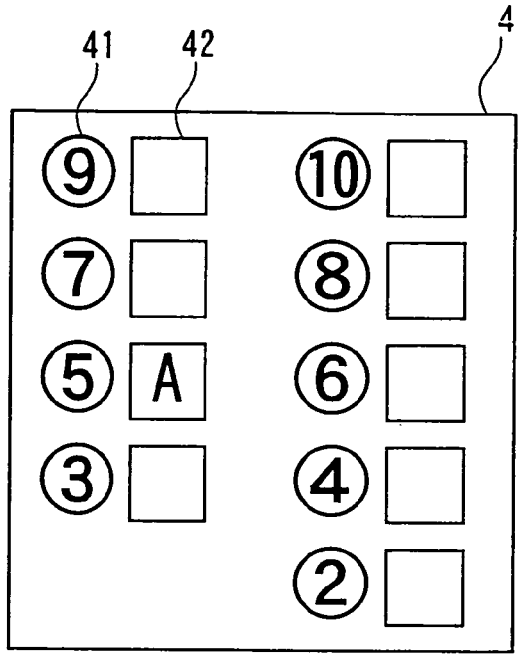
FIG. 2 is a front view of the destination floor registration device installed at each floor in accordance with the present invention.

FIG. 2 is a front view of the destination floor registration device 4 installed at each floor in accordance with the present invention. This figure schematically shows its configuration.

In FIG. 2, reference numeral 41 denotes a destination floor registration button used by a passenger to register a desired destination floor while 42 denotes a response car display panel to indicate to, the passenger which car or hall will serve for the registered destination floor. In the example of FIG. 2, the fifth floor is registered as a destination floor and car A will arrive in response to the destination call or a car will arrive at hall A to serve the destination call.

Note that this destination floor registration device 4 is not limited to the form of FIG. 2. What is required of the destination floor registration device 4 is that it can allow passengers at the hall to register destination floors and notify passengers which cars or halls will respectively serve for the registered destination floors. The destination floor registration device 4 may be of any form if it is satisfactorily provided with these capabilities.

With reference to FIGS. 3 through 7, the following describes how this embodiment of the present invention operates.

Of the operations of this embodiment of the present invention, the zone setting operation and the subsequent entrance judgment operation, and withdrawal operation are described at first.

Figure 3:
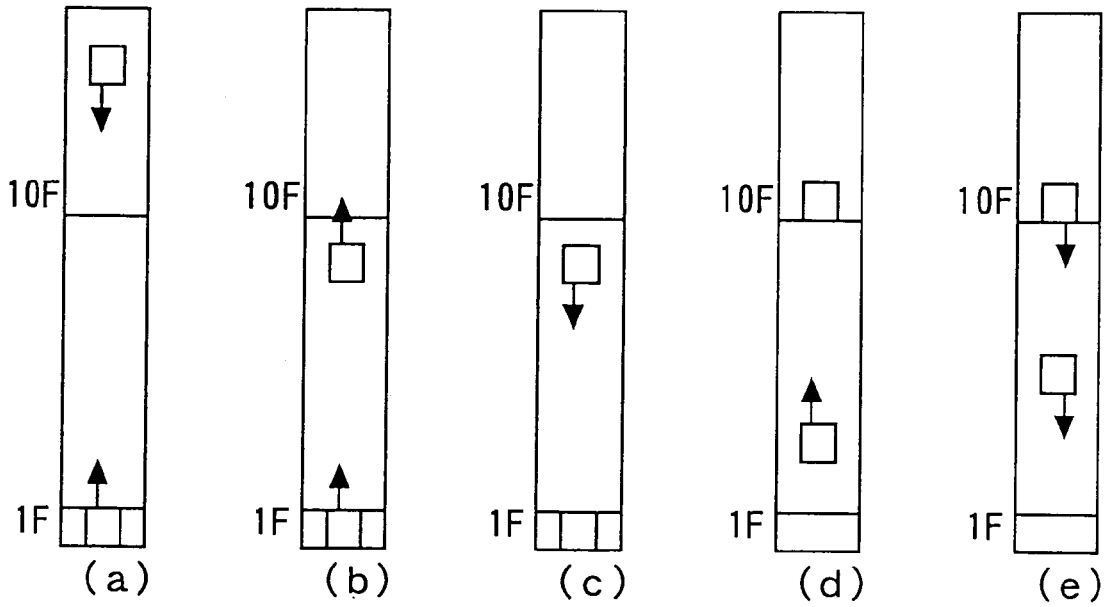
FIG. 3 is provided to explain the zone setting operation and the subsequent entrance judgment operation in this embodiment of the present invention.
Figure 4:
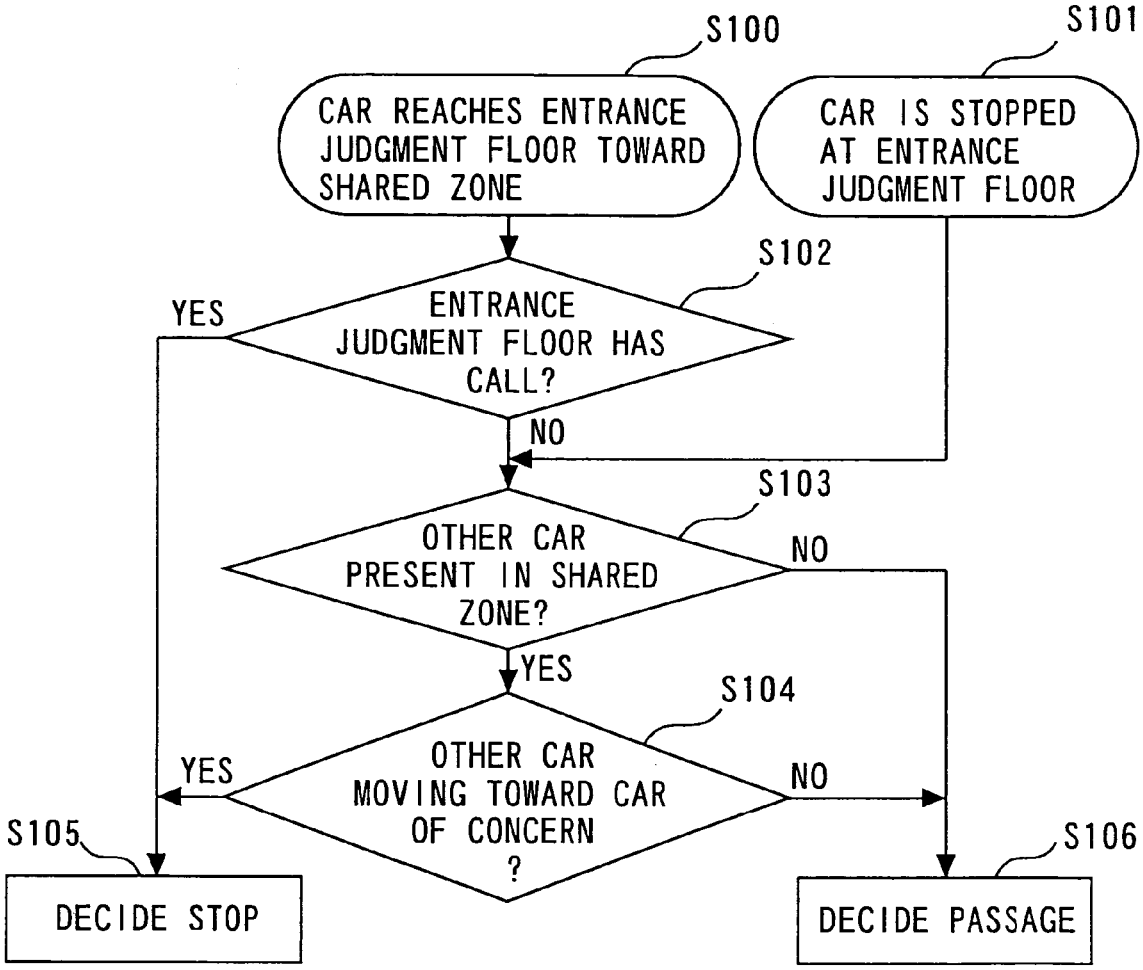
FIG. 4 is a general flowchart of the entrance judgment operation in this embodiment of the present invention.
Figure 5:
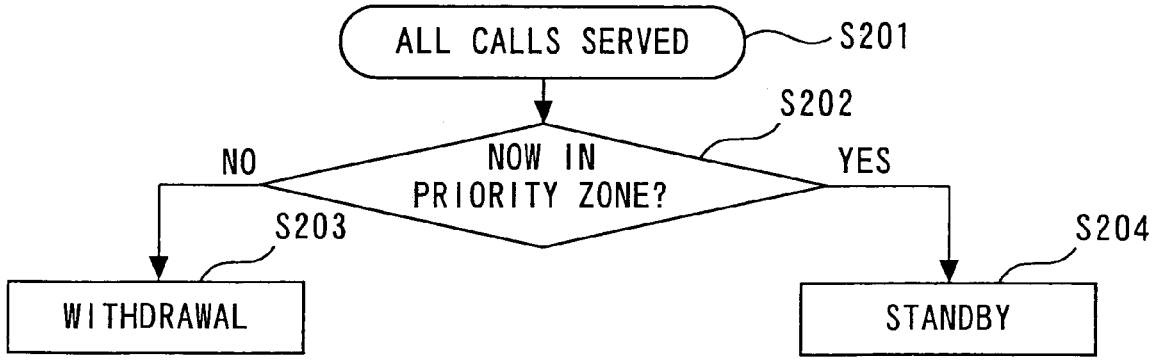
FIG. 5 is also a general flowchart of the withdrawal operation in this embodiment of the present invention.

FIG. 3 is provided to explain the zone setting operation and the subsequent entrance judgment operation in this embodiment of the present invention. FIG. 4 is a general flowchart of the entrance judgment operation. FIG. 5 is also a general flowchart of the withdrawal operation.

FIG. 3 shows an example of setting a priority zone and a shared zone. In FIG. 3, the tenth floor (10F) and upper floors are set as the priority zone of the upper cars. If a destination call occurs at a floor within this upper car priority zone, one of the upper cars shall respond to the call. The lower cars shall not be allowed to enter the upper car priority zone. Additionally, the first floor (1F) alone is set as the priority zone of the lower cars in FIG. 3. The first floor (1F) shall be served exclusively by the lower cars.

In addition, the second floor through ninth floors (2F-9F) form a shared zone. This shared zone is served by both upper and lower cars. Preferably, the priority zones and the shared zone are set as follows:

(1) The lobby floor and lower floors are set as the lower car priority zone.

(2) The upper floors of which residents accounts for a half of the total number of residents in the building are set as the upper car priority zone.

(3) The remaining intermediary floors are set as the shared zone.

This is merely a general rule. The boundaries may be somewhat higher or lower depending on the distribution of tenants and the purposes of floors. Furthermore, the set zones may be varied during a day according to changing traffic so as to keep a balance of load between the upper cars and the lower cars.

If the zones are set as shown in the example of FIG. 3, it is not possible for any car to carry passengers from the first floor (1F) to the tenth floor (10F) or higher floors. In this case, however, it is possible to guide such passengers to the second floor (2F) as appropriate by such a simple method as installing a guide plate, indication display or the like on the first floor (1F). Zoning is employed even in ordinary elevator systems having one car per shaft. In addition, guidance to the second floor (2F) is widely implemented in double deck systems.

The above-mentioned zone setting is performed by the zone setting means 1B.

In an elevator system which the present invention concerns, it is necessary to prevent collision between upper and lower cars. The shard zone entrance judgment operation and the withdrawal operation are performed for this purpose.

With examples of FIG. 3, the shared zone entrance judgment operation is firstly described along with the flowchart of FIG. 4. In FIG. 3, the entrance judgment floor for the lower car is the first floor (1F) and that for the upper car is the tenth floor (10F). When a car reaches its entrance judgment floor, it is decided whether to stop the car at the floor in order to prevent collision. This judgment is made based on whether the other car (the lower car in the same shaft if the car of concern is an upper car or the upper car in the same shaft if the car of concern is a lower car) is present in the shared zone and coming closer to the car of concern.

Turning to FIG. 4, if a car reaches its entrance judgment floor while moving toward the shared zone (ascending if the car is a lower car or descending if the car is an upper car) in step S100, it is firstly judged in step S102 whether the floor has a call the car should respond to. If the floor has such a call, control goes to step S105 and it is decided there to stop the travel. Reversely; if the floor does not have such a call, control goes to step S103 and it is judged there whether the other car is present in the shared zone. If the other car is not present in the shared zone, control goes to step S106 and it is decided there to pass the floor (to enter the shared zone) since it is safe for the car of concern to enter the shared zone. If the other car is present in the shared zone in step S103, it is also judged in step S104 whether the other car is moving toward the car of concern. If the other car is moving toward the car of concern, control goes to step S105 and it is decided there to stop the travel since the risk of collision would rise if the car of concern enters the shared zone. If the other car is moving in the same direction as the car of concern, control goes to step S106 and it is decided there to pass the floor (to enter the shared zone).

In addition, when a car is stopped at its entrance judgment floor and is going to travel toward the shared zone (step S101), a decision is made by following the same procedure, starting from step S103 in this case.

In the cases of FIG. 3, the lower car is allowed to enter in cases (a) and (b), and not allowed to enter in case (c) and the upper car is not allowed to enter in case (d) and is allowed to enter in case (e). These judgments are made according to the procedure of FIG. 4.

It is clear that if a decision on whether to allow a car to enter the shared zone is made at its entrance judgment floor as described above, the risk of collision between the upper and lower cars is greatly reduced.

Note that the above-mentioned Judgment procedure is implemented by the entrance judgment means 1C. In addition, if it is decided to stop the car in step s105, the safety standby means 1D issues a safety stop/standby command to the car.

Then, the withdrawal procedure is described below with reference to FIG. 5.

Upon completion of all calls assigned to a car as shown in step S201, control goes to step S202 and it is judged there whether the current position of the car is in its priority zone. If the car is present in the priority zone, control goes to step S204 to put the car on standby at the current position with the door closed since collision does not occur with the other car. If the car is present not in the priority zone but in the shared zone in step S202, control goes to step S203 to withdraw the car to a certain floor within the priority zone since the car, if left at the current position, would disturb the travel of the other car. The withdrawal floor may be any floor within the priority zone. Considering the avoidable travel, the floor adjacent to the shared zone should be set as the withdrawal floor. The withdrawal procedure of FIG. 5 is implemented by the withdrawal means 1E.

Figure 6:
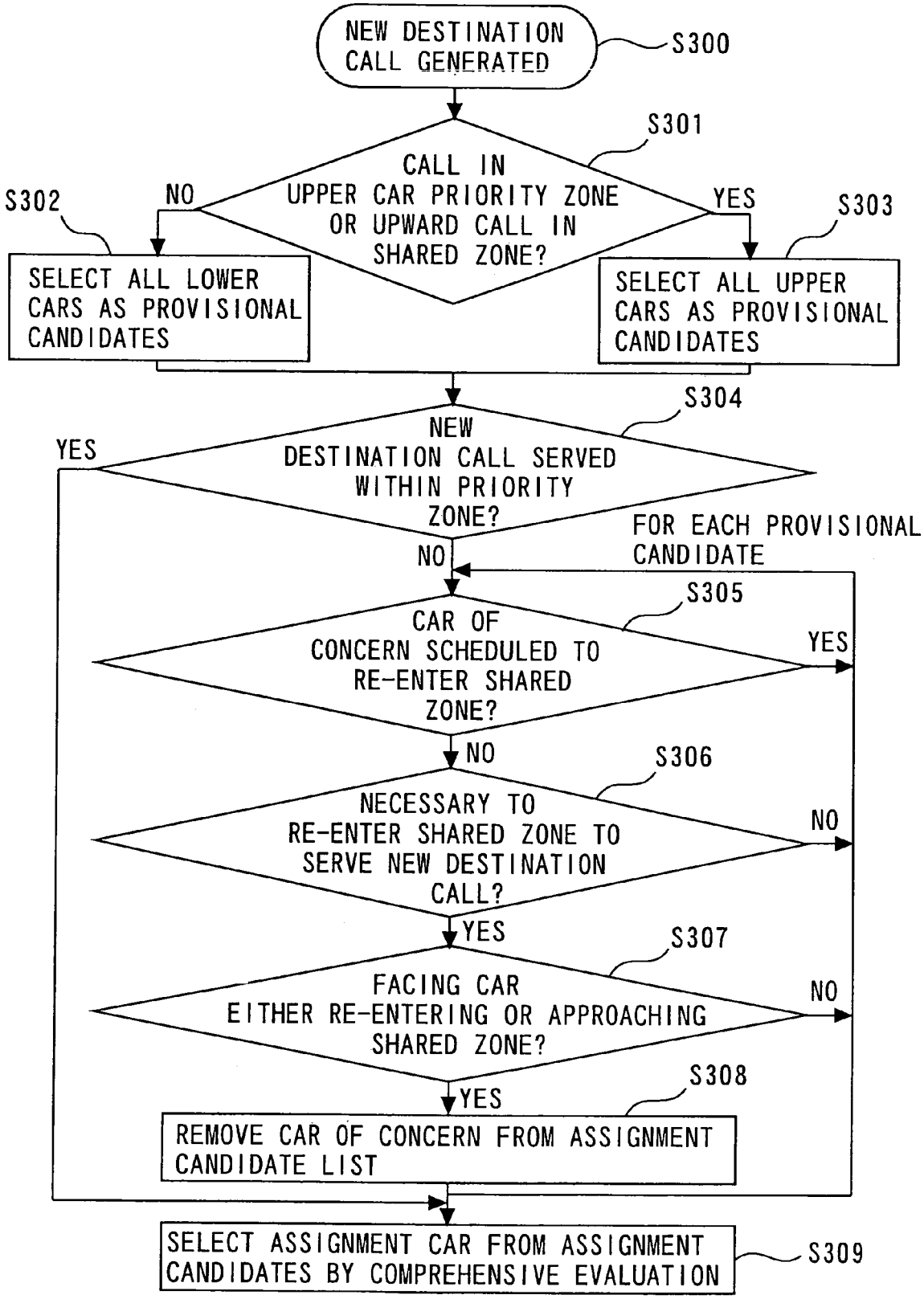
FIG. 6 is a general flowchart showing the assignment car determination procedure to be followed when a new destination call is generated in this embodiment of the present invention.
Figure 7:
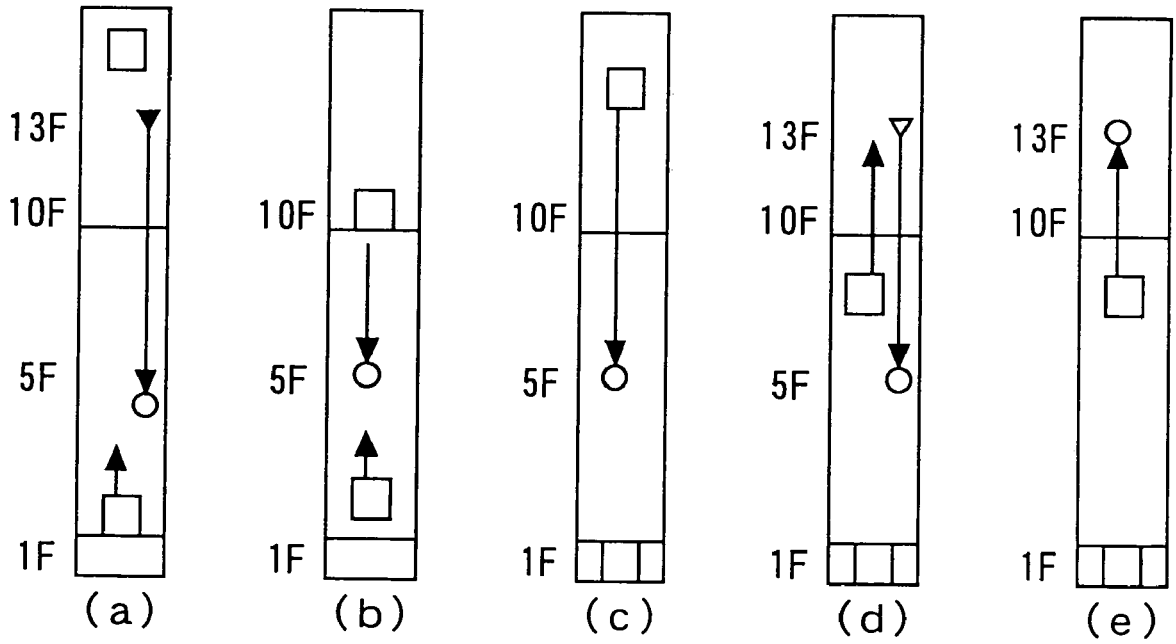
FIG. 7 is provided to complement the description of the assignment car determination procedure in this embodiment of the present invention.

Then, the following describes what procedure is followed in determining which car is to be assigned to a newly generated destination call with reference to FIGS. 6 and 7. FIG. 6 is a general flowchart showing the assignment car determination procedure to be followed when a new destination call is generated. FIG. 7 is provided to complement the description of the assignment car determination procedure.

Firstly, if a new destination call occurs in step S300 of FIG. 6, it is judged in step S301 which zone has generated the new destination call and whether the call is upward or downward. If the call is generated in the upper car priority zone, it is judged that the call should be assigned to an upper car since the lower cars cannot serve the call. If the call is an upward call generated in the shared zone, it is also judged that the call should be assigned to a upper car. In this case, control goes to step S303 to provisionally select all upper cars as candidates for assignment.

If it is judged in step S301 that the call is not generated in the upper car priority zone and that the call is not an upward call generated in the shared zone, it is judged that the call should be assigned to a lower car. In this case, control goes to step S302 to provisionally select all lower cars as candidates for assignment.

In order to lower the risk of collision and reduce the unnecessary withdrawal travel, the procedure consisting of steps S301 through S303 in accordance with the present invention selects provisional assignment candidates as mentioned above since if an upper car is assigned to an upward call generated in the shared zone, the assigned upper car would automatically go out of the shared zone.

Consideration should be given to not only the risk of collision but also safety standby. In accordance with the present invention, entrance judgment is made when a car is to enter the shared zone as described with FIG. 4. If the car is stopped for safety, the passengers must wait in the closed car although the waiting time is short.

This is described below with reference to examples of FIG. 7. In FIG. 7, assume that a new call is generated at a hall on the thirteenth floor (13F) for the fifth floor (5F). In the case of (a), the upper car is on standby with door closed at the topmost floor while the lower car is going up in the shared zone. If the new call is assigned to the upper car, the upper car receives passengers at the thirteenth floor (13F) and reaches the entrance judgment floor, namely the tenth floor (10F) where the car must be stopped for safety (FIG. 7(*b*)) according to the procedure of FIG. 4. The passengers must wait in the upper car until the upper car is allowed to enter the shared zone when the moving direction of the lower car turns downward.

Considering the psychology of passengers, such a situation should be prevented if possible. Step S304 and subsequent steps of the procedure shown in FIG. 6 are provided to prevent such a situation.

In step S304 of FIG. 6, it is judged whether the new destination call is generated in the priority zone, that is, whether the new call demands transportation within the priority zone. If the call is generated in the priority zone, control goes to step S309 to finally select a car for assignment from the provisional candidates selected in step S302 or S303 since the call can be served without having to enter the shared zone.

If it is judged in step S304 that the new destination call is not generated within the priority zone, that is, the call demands transportation between floors one or both of which is or are in the shared zone, step S305 and subsequent steps are performed on the provisional candidates selected in step S302 or S303.

Firstly, it is judged in step S305 whether a car of concern is scheduled to re-enter the shared zone regardless of whether the car is assigned to the new call. This re-entrance means that the car must enter the shared zone in order to serve a call assigned to the car.

This is described below with reference to examples of FIG. 7. In the case of FIG. 7(*c*), although the upper car is currently present in the upper car priority zone, it is judged that the upper car is scheduled to enter the shared zone since the car is assigned a call demanding transportation to the fifth floor (5F). In the case of FIG. 7(*d*), the upper car is already assigned a call demanding transportation from the thirteenth floor (13F) to the fifth floor (5F). In this case, since the upper car is scheduled to exit the shared zone once and again enter the shared zone, it is judged that the car is scheduled to re-enter the shared zone. In the case of FIG. 7(*e*), although the upper car is currently present in the shared zone, it is judged that the car is not scheduled to re-enter the shared zone since the single call assigned to the car demands transportation to the thirteenth floor (13F).

If it is judged in step S305 that a car of concern is scheduled to re-enter the shared zone, this car is left as a candidate for assignment. This is based on the assumption that assigning a new call to the car does not cause another safety standby since the car will enter the shared zone regardless of whether the new call is assigned or not. If it is judged that the car is not scheduled to re-enter the shared zone, control goes to step S306.

In step S306, it is judged whether the car will re-enter the shared zone if the car is assigned to the new call. If the car will not re-enter, the car is left as a candidate for assignment. If the car will re-enter, control goes to step S307.

In step S307, it is judged whether the other car facing the car of concern is either re-entering or approaching the shared zone. If Yes in step S307, control goes to step S308 to remove the car of concern from the list of assignment candidates since safety stop is predicted to occur. If No in step S307, the car is left as a candidate for assignment.

By executing step S308 and the preceding steps as described, it is possible to pick up assignment candidate cars which can serve the new destination call without causing safety stop.

After assignment candidates are selected through the S308 and preceding steps, step S309 finally determines which of the candidates is to be assigned. Various methods are possible in this determination. One method is to comprehensively evaluate several kinds of indexes such as wait time and crowding probability for new destination call assignment. By way of example, the following evaluation function may be used.

$J(e)=\min J(I)$, $e$: Assigned car, $I\in$ Candidate car, $J(I)=\Sigma w_i \times f_i(x_i)$, $w_i$: Weight and $X_i$: Individual evaluation value such as wait time Calculation of these various evaluation indexes is widely employed in ordinary group control systems. One example is described in Japanese Patent Laid-open No. 54-102745.

Upon determination of a car to be assigned, operation commands are issued, including an assignment command to the determined car.

INDUSTRIAL APPLICABILITY

As described in the foregoing, an elevator group control apparatus of the present invention can raise the total transportation efficiency of the elevator system while minimizing the risk of collision and the frequency of safety stop.

The invention claimed is:

1. An elevator group control apparatus for an elevator system where a plurality of cars can move in each shaft independently of each other, comprising:

a destination floor registration device which is installed at each hall and registers destination floors and indicates to passengers which cars will respectively respond to serve registered destination floors;

zone setting means for setting priority zones and a shared zone for upper cars and for lower cars;

entrance judgment means for judging whether entrance of the shared zone set by the zone setting means by an upper car or a lower car is permitted;

safety standby means for putting a car on standby based on a judgment of the entrance judgment means;

withdrawal means for withdrawing a car to a withdrawal floor, as necessary, after a service is completed by the car;

assignment candidate selecting means for selecting a car as a candidate for assignment to a destination call generated at a hall if, according to the destination to be served by each car and the zones set for each car, the car would cause neither a collision nor a safety stop; and assignment means for finally determining which car to assign based on selection by the assignment candidate selecting means.

2. The elevator group control apparatus according to claim 1, wherein said destination floor registration device includes:

destination floor registration buttons to respectively register destination floors; and response car indication panels respectively placed adjacent to the destination floor registration buttons.

3. The elevator group control apparatus according to claim 1, wherein said zone setting means sets:

a lobby floor and lower floors as the priority zone of the lower cars, uppermost floors, which account for about one-half of the total number of floors as the priority zone of the upper cars, and remaining intermediary as a shared zone.

4. The elevator group control apparatus according to claim 1, wherein, if a first car is present in the shared zone when a second car reaches an entrance judgment floor, said entrance judgment means stops the first car at the entrance judgment floor if the second car is coming closer to the first car and permits the first car to pass if the second car is moving in the same direction as the first car.

5. The elevator group control apparatus according to claim 1, wherein, upon completion of a service by a car, said safety standby means puts the car immediately on standby with the door closed if the car is present in the priority zone and withdraws the car to a floor in the priority zone if the car is present in the shared zone.

6. The elevator group control apparatus according to claim 1, wherein said assignment candidate selecting means judges whether a car is scheduled to re-enter the shared zone and, if the car is scheduled to re-enter, leaves the car as a candidate for assignment.

7. The elevator group control apparatus according to claim 1, wherein said assignment candidate selecting means judges whether a car must re-enter the shared zone to serve a new destination call and, if the car must not re-enter, leaves the car as a candidate for assignment.

* * * * *